US010058141B2

(12) United States Patent
Liu

(10) Patent No.: US 10,058,141 B2
(45) Date of Patent: Aug. 28, 2018

(54) HAT CLIP APPARATUS

(71) Applicant: Richard Liu, San Francisco, CA (US)

(72) Inventor: Richard Liu, San Francisco, CA (US)

( * ) Notice: Subject to any disclaimer, the term of this patent is extended or adjusted under 35 U.S.C. 154(b) by 216 days.

(21) Appl. No.: 15/068,229

(22) Filed: Mar. 11, 2016

(65) Prior Publication Data

US 2017/0258167 A1 Sep. 14, 2017

(51) Int. Cl.

| | |
|---|---|
| ***A42B 1/24*** | (2006.01) |
| ***A42C 5/02*** | (2006.01) |
| ***A42B 1/06*** | (2006.01) |
| ***A42B 1/00*** | (2006.01) |

(52) U.S. Cl.

CPC ..... *A42B 1/24* (2013.01); *A42B 1/004* (2013.01); *A42B 1/062* (2013.01); *A42C 5/02* (2013.01)

(58) Field of Classification Search

CPC ..... A42B 1/24; A42B 1/004; A42B 1/062; A42C 5/02

See application file for complete search history.

(56) References Cited

U.S. PATENT DOCUMENTS

| | | | | |
|---|---|---|---|---|
| 5,860,191 | A * | 1/1999 | Sieger | A45F 5/02 24/13 |
| 6,357,642 | B1 * | 3/2002 | Marchessault | A42B 1/24 2/209.13 |
| 6,953,259 | B2 * | 10/2005 | Parsons | F21V 21/0885 362/191 |
| 7,325,920 | B1 * | 2/2008 | Gelfuso | A42B 1/247 2/10 |
| 8,020,825 | B2 * | 9/2011 | Dostaler | A47G 23/0225 24/332 |
| 8,769,727 | B1 * | 7/2014 | Hester | A42B 1/08 2/422 |
| 2006/0048274 | A1 * | 3/2006 | Lee | A42B 1/062 2/181 |

* cited by examiner

*Primary Examiner* — Anita M King

(74) *Attorney, Agent, or Firm* — Kilpatrick Townsend & Stockton LLP

(57) ABSTRACT

The technology disclosed herein provides a method and device for storing and transporting a hat that is compact and addresses the problem of attaching a hat to a carrier, for example a bag, without the primary use of friction or clamping force to secure the hat, as these tend to damage the hat. More specifically, the clipping apparatus attaches to the hat by utilizing features of the hat to create mechanical interlocks to secure the hat, as opposed to friction. Further the device is easily and repeatedly attachable and removable from a hat without causing damage to the hat.

14 Claims, 10 Drawing Sheets

HAT CLIP APPARATUS

BACKGROUND OF THE INVENTION

Field of the Invention

The present invention relates to hat accessories for attaching a hat to another object. More particularly the technology relates to clip apparatuses removably attachable to a baseball style hat without causing damage to the hat and removably attachable to another object, for example a handle of a bag.

Description of Related Art

Historically, great care was taken in the transport of hats due to their delicate nature and great cost. When not being worn hats were transported in large hat boxes which prevented the hats from being crushed and damaged. While hats have become relatively less expensive and less delicate, there is a still desire to prevent damage to hats during travel and storage. The desire to prevent damage to hats is especially true for collectors of baseball style hats who desire to maintain smooth brims and well shaped covering portions.

Damage to the brim and covering portion of baseball style hats may occur if the hat is stowed or transported in a bag along with other contents. For example, the brim or fabric of the covering portion may be bent or crushed between two books in a backpack. As mentioned above, the use of a hat box would prevent this undesirable damage to baseball style hats. However, hat boxes are impractical because they are large, and would need to be stored and transported when the hat is being worn. Therefore, there exists a need of a way to transport a hat without damaging the hat that does not involve a large box.

Attaching a hat to the exterior of a bag has been done using clamps and barbed slots, which prevents damage that would occur if the hat were placed inside the bag. However these devices pose the problem of creasing the fabric or causing damage to the fabric of the hat. For example, applying force to hat with a clamp may abrade the fabric as it is pulled through the closed clamp. Therefore, there exists a need of a way to attach a hat to a bag without the use of clamps, barbed slots, or other friction type devices.

Therefore it is desirable to provide a method and device for storing and transporting a hat that is compact and leaves the hat free from creases of the fabric or brim, as well as damage to the fabric.

SUMMARY OF THE INVENTION

The technology disclosed herein provides a method and device for storing and transporting a hat that is compact and addresses the problem of attaching a hat to a carrier, for example a bag, without the primary use of friction or clamping force to secure the hat, as these tend to damage the hat. More specifically, the clipping apparatus attaches to the hat by utilizing features of the hat to create mechanical interlocks to secure the hat, as opposed to friction. Further the device is easily and repeatedly attachable and removable from a hat without causing damage to the hat.

The clip apparatus includes a first body and a second body. The first body is connected to the second body with a hinge mechanism located at a mid-position of the first body. The clip apparatus utilizes the sweatband and/or a raised emblem on the hat to secure the hat. This allows the hat to be secured to baseball style hats because many baseball style hats include an emblem on the back and a sweatband.

Other aspects and advantages of the present invention can be seen on review of the drawings, the detailed description and the claims, which follow.

DETAILED DESCRIPTION

Figure 1A:
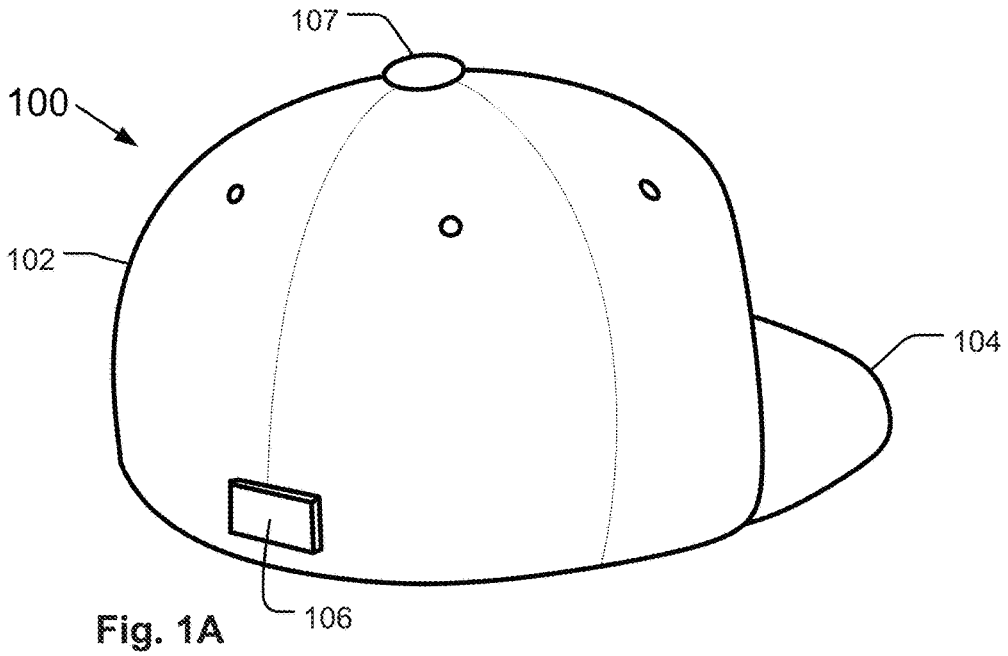
FIG. 1A is a perspective view of a rear side of a baseball style hat.

The following description of the disclosure will typically be with reference to specific structural embodiments and methods. It is to be understood that there is no intention to limit the disclosure to the specifically disclosed embodiments and methods, but that the disclosure may be practiced using other features, elements, methods and embodiments. Preferred embodiments are described to illustrate the present disclosure, not to limit its scope, which is defined by the claims. Those of ordinary skill in the art will recognize a variety of equivalent variations on the description that follows. Like elements in various embodiments are commonly referred to with like reference numerals.

Figure 1B:
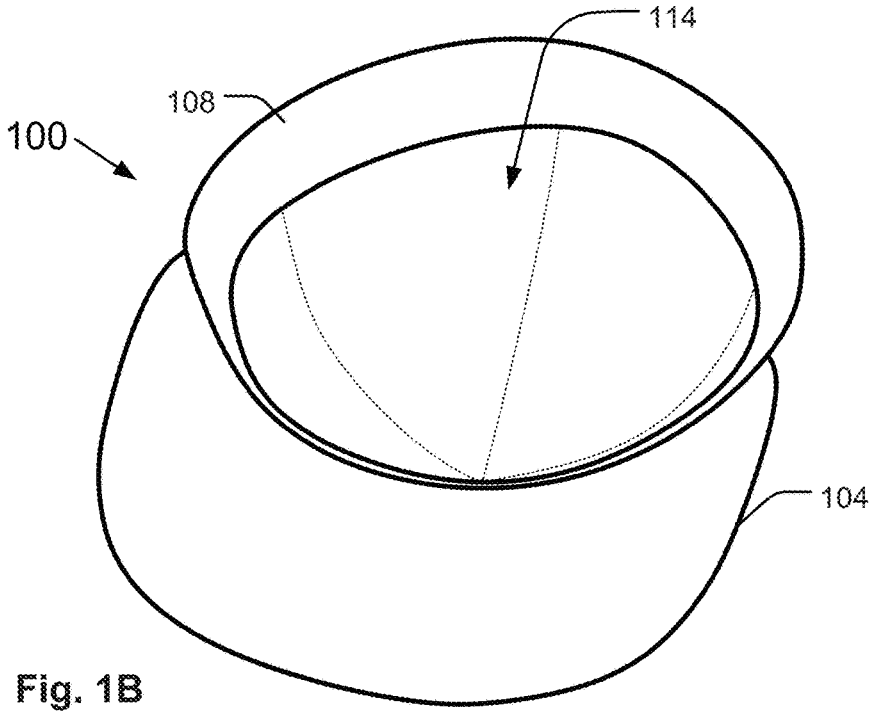
FIG. 1B is a perspective view of a bottom side of a baseball style hat.
Figure 1C:
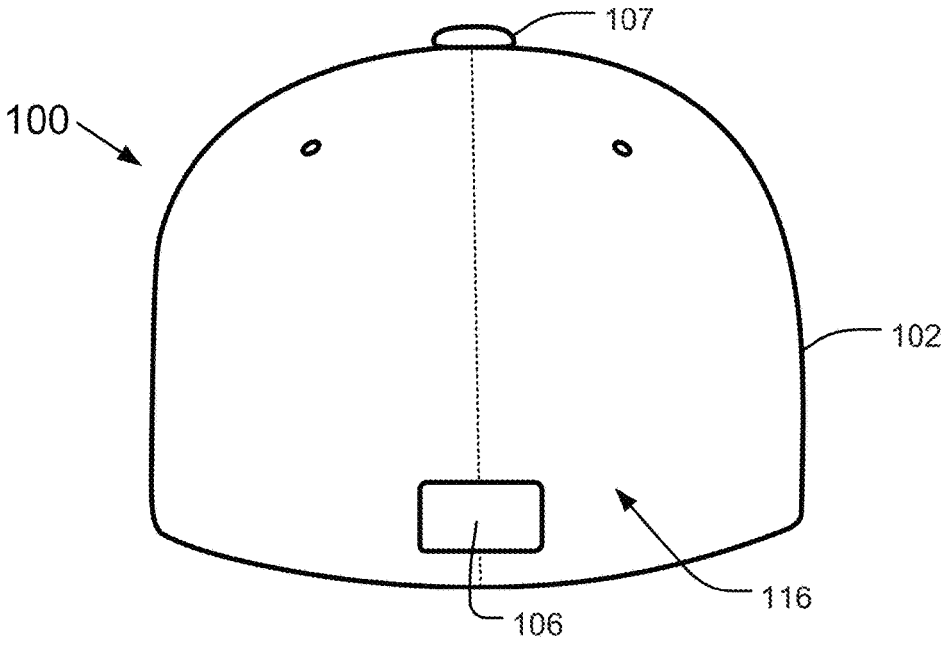
FIG. 1C is a rear view of a baseball style hat.

FIGS. 1A-D illustrate an example of a hat 100, as shown a baseball style hat, that may be used with clip apparatuses, also referred to as hat attachment devices, disclosed herein. As shown in FIG. 1A, the hat 100 includes a covering portion 102, also referred to as a main hat body, suitable for being fit over a wearer's head. The hat further includes a brim 104 on a front side of the hat 100, a raised emblem 106 on the lower backside of the hat, and a button 107, as shown in FIGS. 1A and 1B. The raised emblem is sometimes referred to as a puffed or 3D embroidery and comprises a foam core surrounded in hundreds or thousands of lines of embroidery thread. As shown the raised emblem is in the center of the back of the hat, however the raised emblem may be located anywhere along the lower edge of the hat, and a clip apparatus may be attached to the hat at a location corresponding to the location of the raised emblem.

Figure 1D:
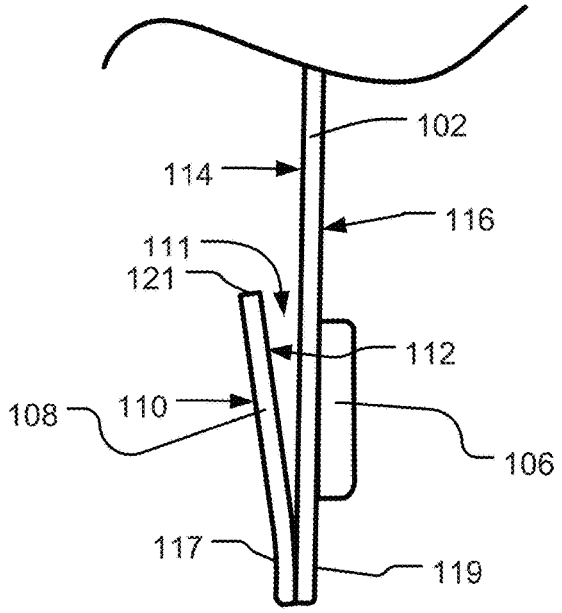
FIG. 1D is a cross-sectional view of a baseball style hat.

Further, as shown in FIGS. 1B and 1D, the lower portion of the covering portion 102 includes a sweatband 108 along at least portions of the head opening of the hat 100. The sweatband includes an inner sweatband surface 110, which contacts the wearer's head when the hat is worn, and an outer sweatband surface 112. The covering portion 102 includes an inner covering surface 114, which contacts the wearer's head when the hat is worn, and an outer covering surface 116. The lower edge 117 of the sweatband 108 is attached to the lower edge 119 of the covering portion 102. The sweatband 108 and covering portion 102 form a channel 111 between the inner covering surface 114 and outer sweatband surface 112 as shown in the cross-section of the hat 100 in FIG. 1D.

FIGS. 1A-D show a baseball style hat, however the clip apparatuses disclosed herein may be used with other types of hats, caps, and visors, without departing from the spirit of the technology.

Figure 2A:
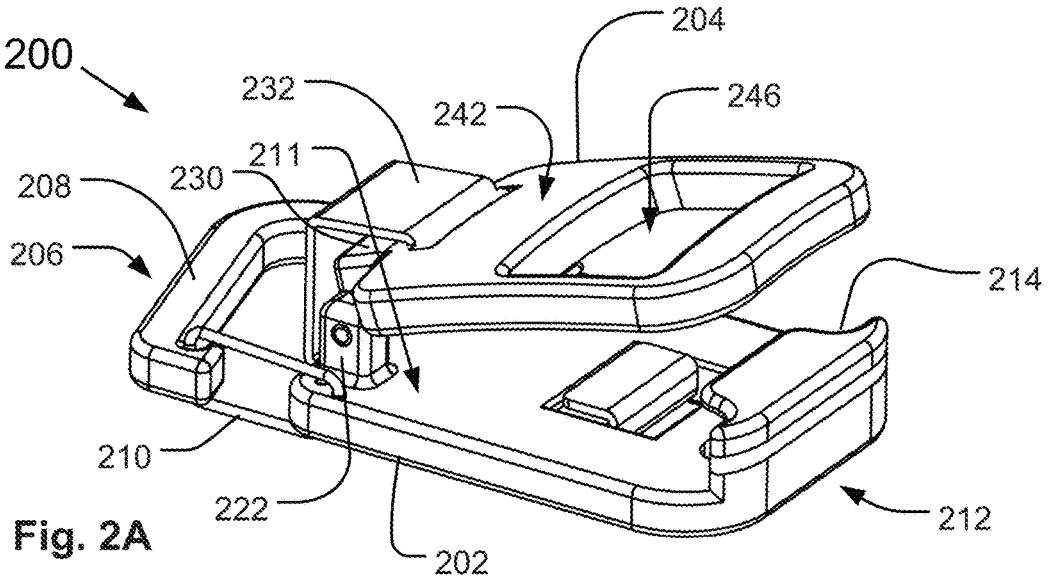
FIG. 2A is a perspective view of a clip apparatus in an open position.

FIG. 2A shows a perspective view of a clip apparatus 200 in an open position. The clip apparatus 200 comprises a first body 202 and a second body 204. In the embodiment shown, the first and second bodies are substantially planar rectangular bodies, however other shapes and curvatures are envisioned. The first body 202 comprises a first end 206 including an attachment means for attaching the clip apparatus to a carrier article, for example a handle of a bag or a hook on a wall. In the embodiment shown the attachment means comprises a hook 208 and spring gate 210 forming a carabiner like attachment mechanism to attach the clip apparatus to a loop, for example the handle of a bag, a belt loop, or a belt.

In embodiments the attachment means comprises an aperture, for example a circular hole for passing cord through, or a slit for passing webbing through. The cord or webbing may be permanently or semi-permanently affixed to a bag. For example, a loop of webbing sewn to a bag may pass through the slit of the attachment means, or a loop of webbing may pass through the slit of the attachment means and through a slit of a side release buckle. Further, in embodiments the attachment means comprise a portion of a side release buckle, or similar device, formed integrally with the first body. A complementary end portion of the side release buckle may be permanently or semi-permanently attached to a bag. Further, in embodiments, the attachments means comprises a slot configured to receive and attach to a belt, a waistband, a strap, or similar thin flat article.

The first body 202 further comprises a top surface 211 and a second end 212, located opposite the first end 206. Extending from the top surface 211 at the second end 212 is a retainer 214. The retainer 214 includes a first portion 216, also referred to as a first leg, extending away from the top surface 211 and a second portion 218, also referred to as a second leg, extending from the first portion 216 toward the first end 206 and forming a slot 220 between the top surface 211 of the first body 202 and the second portion 218. The slot 220 is configured to receive the top edge 121 of the sweatband 108 of the hat 100 so that the second portion 218 is located within the channel 111 of the hat 100, as will be discussed below. In embodiments, the slot 220 spans the width of the second body 204 and may range from 0.4 to 1.2 mm deep and from 1.2 to 2.0 mm between the second portion 228 and the top surface 211.

The first body 202 further comprises hinge elements located between the first end 206 and second end 212. In the embodiment shown the hinge elements comprise hinge knuckles on the first body 202 including a first hinge post 222 and a second hinge post 224, as shown in FIG. 2F. The first and second hinge posts include sleeves 226 for receiving pins 228 to form a pivoting hinge connection between the second body 204 and the first body 202.

Figure 2B:
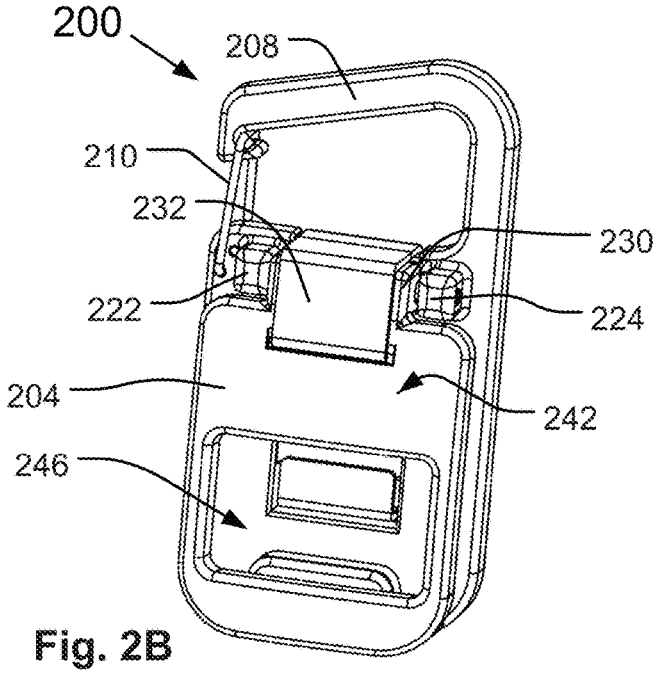
FIG. 2B is a perspective view of clip apparatus in a closed position.
Figure 2C:
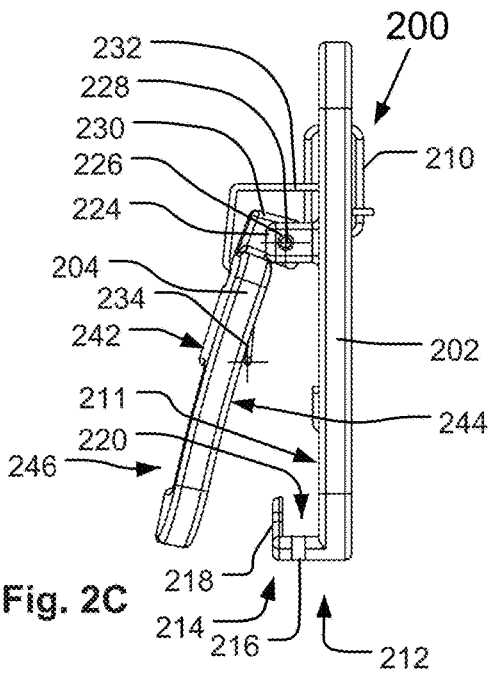
FIG. 2C is a side view of a clip apparatus in the open position of FIG. 2A.
Figure 2D:
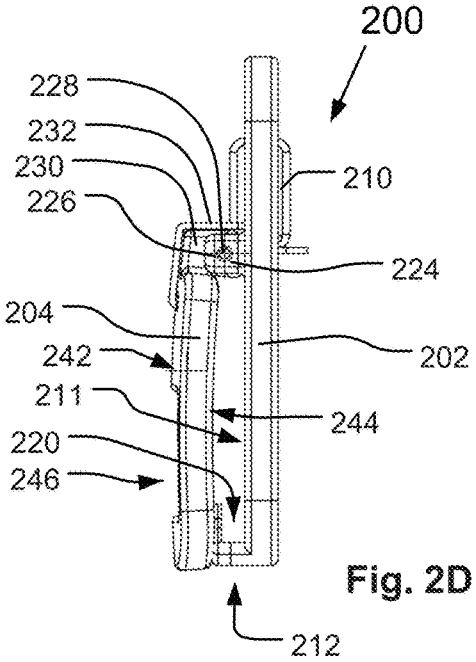
FIG. 2D is a side view of a clip apparatus in the closed position of FIG. 2B.

The second body 204 comprises a hinge knuckle 230 on an end, as shown in FIGS. 2A and 2B. The hinge knuckle 230 includes one or more sleeves 231, as shown in FIG. 2G, and is configured to be placed between the first and second hinge posts 222 224, as shown in FIG. 2A. The sleeve 231 of the hinge knuckle 230 is configured to receive the pins 228 from the first and second hinge posts. The first and second hinge posts 222 and 224, pins 228 and hinge knuckle 230 form the hinge mechanism of the device. The hinge mechanism allows for the second body 204 to pivot relative to the first body 202 from the open position shown in FIG. 2A to the closed position shown in FIG. 2B. In embodiments, the pins are steel and the first and second bodies are ABS. In embodiments, the pins may be integrally formed with the hinge posts of the first body or the hinge knuckle of the second body. Further, in embodiments, the sleeves of the hinge posts or hinge knuckle may include an open side allowing a pin to be snapped into the sleeve through the open side. Further, embodiments may include different numbers of hinge posts and knuckles than shown in the embodiment of FIGS. 2A-D.

The hinge mechanism may further comprise one or more biasing or locking mechanisms. In embodiment shown in FIGS. 2A-2D, the hinge mechanism includes a clasp 232. The clasp 232 is slidable between a disengaged position, as shown in FIGS. 2A and 2C, and an engaged position as shown in FIG. 2B. To place the clasp in the disengaged position, the clasp is slid toward the first end 206 and the second body 204 is free to pivot relative to the first body 202 between the open and closed positions. To place the clasp in the engaged position, the clasp is slid toward the second end 212 and the second body 204 is biased toward the closed position by the clasp 232 as shown in FIG. 2B. The hinge mechanism may further include a biasing spring 234. The biasing spring 234 is located between the first body 202 and the second body 234 and creates a biasing force to bias the second body 204 to be in the open position relative to the first body 202. The biasing force of the biasing spring 234 is overcome by the clasp 232 in the engaged position of the clasp.

Figure 2E:
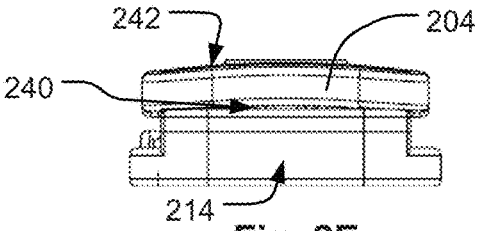
FIG. 2E is an end view of a clip apparatus in the close position of FIG. 2B.
Figure 2F:
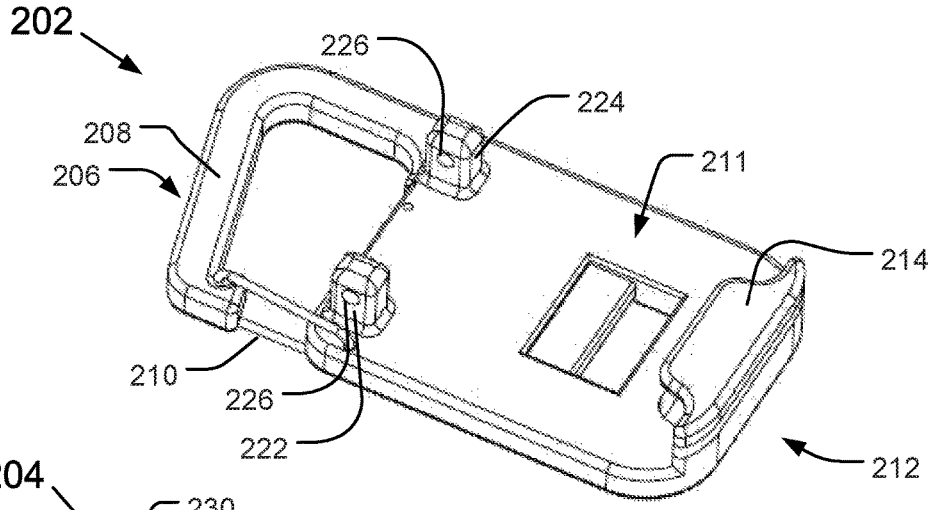
FIG. 2F is a perspective view of a first body.
Figure 2G:
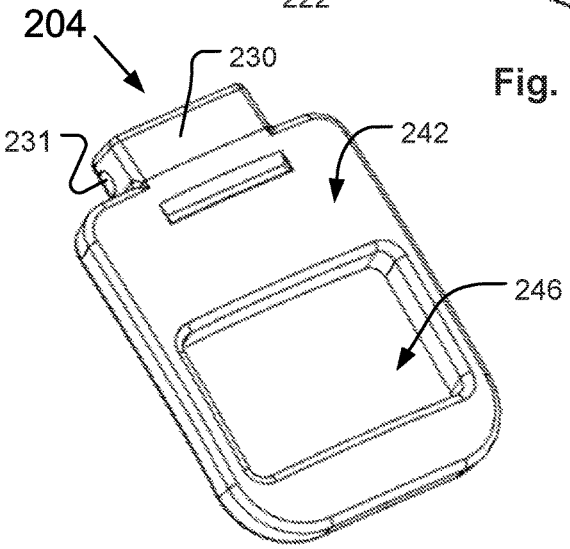
FIG. 2G is a perspective view of a second body.
Figure 2H:
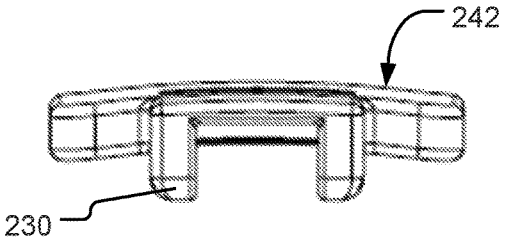
FIG. 2H is an end view of a second body.

As shown in FIG. 2E, in the closed position the second body 204 forms a gap 240 between the second portion 218 of the retainer 214. As will be discussed below the gap is beneficial in preventing damage to a hat attached to the clip apparatus. Further, as shown in FIG. 2D, in the closed position a cavity is formed between the first body 202 and 204 which will receive a portion of a hat, which will be discussed below.

As shown is FIGS. 2A-2C, the second body 204 is a generally planar body. In embodiments, the second body has a width similar to the first body 202 and a length selected so that when in the closed position the ends of the first body and second body substantially align, as shown in FIGS. 2B and 2D.

The second body 204 includes a top surface 242 and a bottom surface 244, and further includes an aperture 246 through the second body 204 from the top surface 242 to the bottom surface 244. In the closed position, the bottom surface 244 of the second body 204 faces the top surface 211 of the first body 202. When the clip apparatus 200 receives a hat 100 in the cavity between the first body 202 and second body 204, the bottom surface 244 of the second body 204 contacts or is directly adjacent to the outer covering surface 116 of the covering portion 102 of the hat 100, as is shown in FIG. 3B. The bottom surface 244 of the second body 204 and the top surface 211 of the first body 202 are free of barbs, sharp points and edges in order to avoid damaging portions of the hat received by the clip apparatus.

Figure 3A:
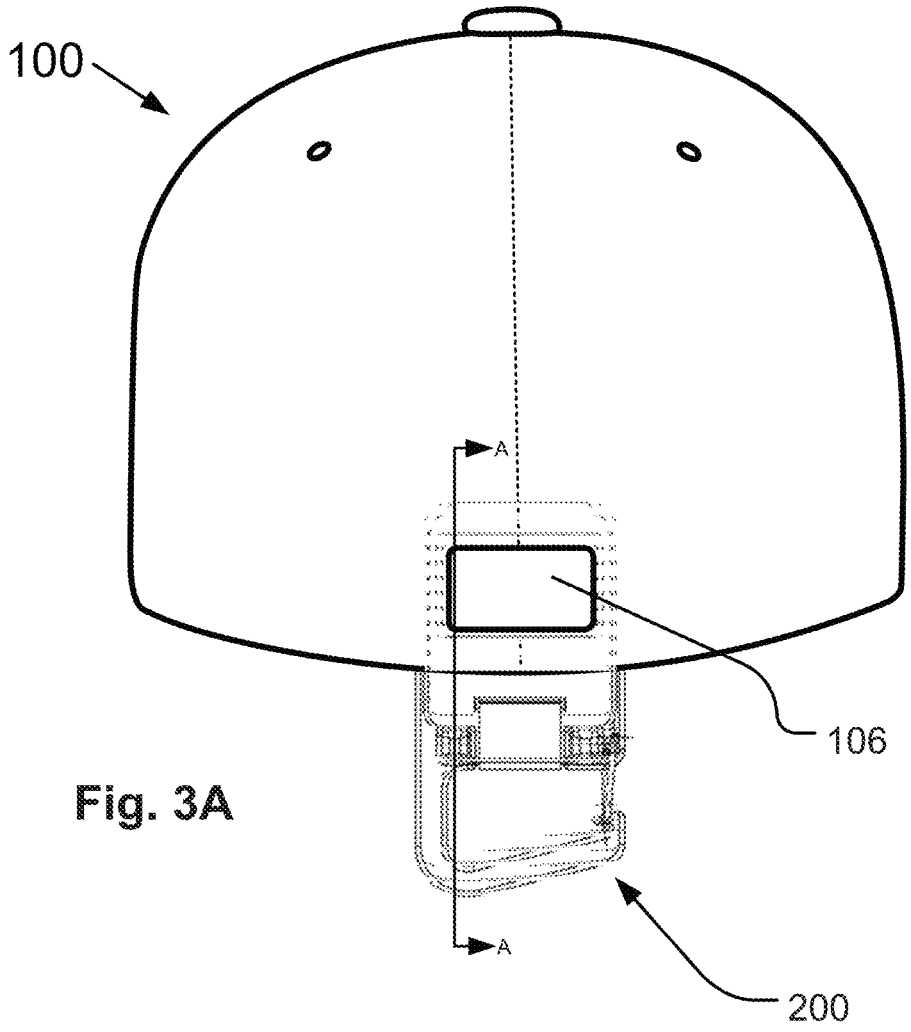
FIG. 3A illustrates a clip apparatus attached to a hat.
Figure 3B:
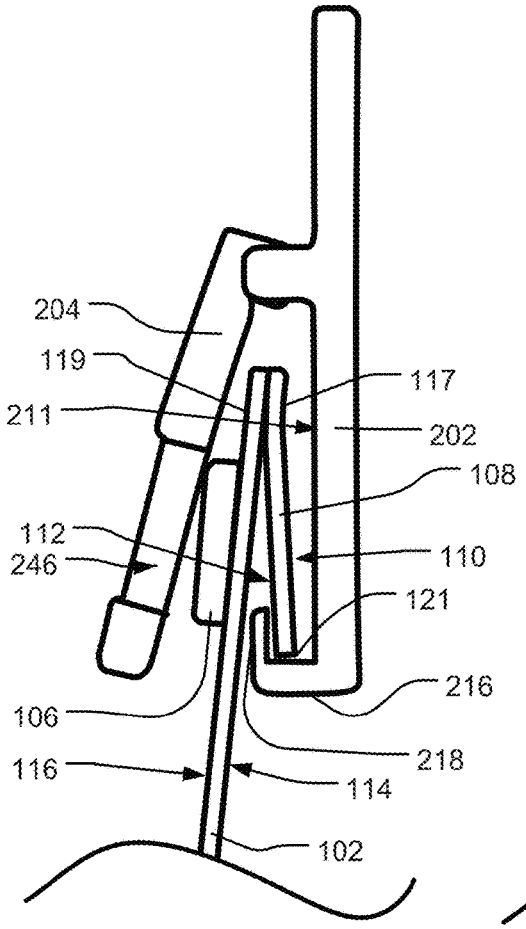
FIG. 3B is a cross-section of a clip apparatus in the open position receiving a hat.

FIG. 3A, shows a clip apparatus 200 attached to a hat 100 including a raised emblem 106. To attach a hat 100 to the clip apparatus 200 the clip apparatus is placed into the open position and the hat is positioned in the clip apparatus so that the top edge of the sweatband 121 is within the slot 220 and the second portion 218 is within the channel 111, as shown in FIG. 3B. In this position, the inner surface of the inner sweatband surface 110 is facing and adjacent to the top surface 211 of the first body 202, and the outer covering surface 116 and raised emblem 106 are facing the second body 204. To secure the hat 100 to the clip apparatus 200, the raised emblem 106 is aligned with the aperture 246 and the clip apparatus is placed into the closed position so that the raised emblem is received in the aperture as is shown in FIG. 3A and corresponding cross-section AA shown in FIG. 3C. In the configuration shown in FIGS. 3A and 3C the combination of the raised emblem 106 in the aperture 246 and sweatband 108 in the slot 220 form two mechanical interlocks which prevent the hat 100 from being removed from the clip apparatus 200 in the closed position. This configuration does not include any substantial clamping or friction force to retain the hat in the clip apparatus because the cavity between the first body and second body is larger than the hat received therein. This frictionless attachment is beneficial in preventing damage to the hat. Further, in this configuration the emblem received in the aperture additionally restricts movement of the sweatband sliding around the clip apparatus in a direction parallel to the top edge of the sweatband.

Figure 3C:
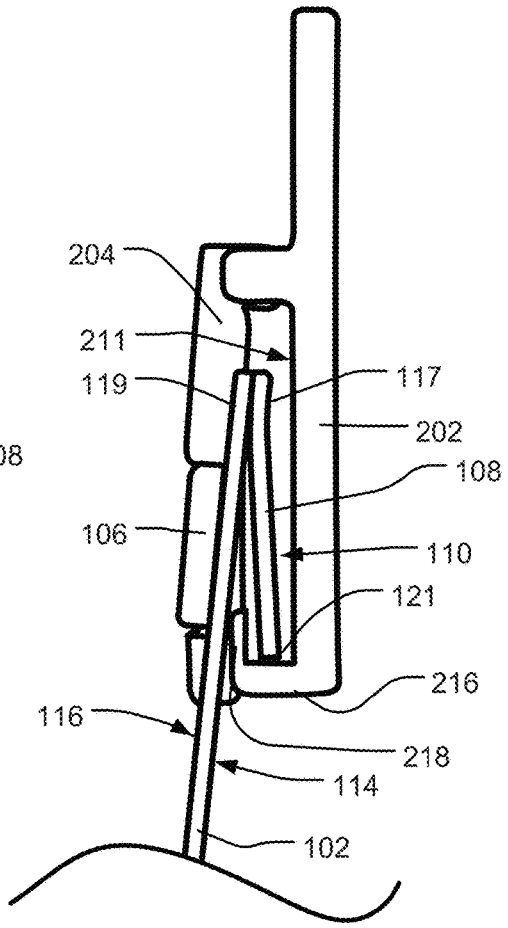
FIG. 3C is a cross-section of a clip apparatus in the closed position attached to a hat.

The embodiment shown in FIGS. 3A-C includes two mechanical interlocks, however embodiments may include a single mechanical interlock to secure a hat to the clip apparatus. For example, an embodiment of a clip apparatuses may include an aperture on the second body and a first body without a retainer, or an embodiment may include a retainer on the first body and a second body without an aperture.

Figure 4A:
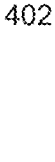
FIGS. 4A and 4B illustrate a rectangular emblem and corresponding aperture.
Figure 4B:
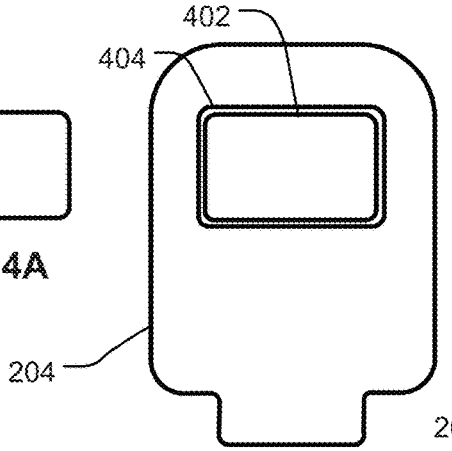

FIG. 4A shows a rectangular emblem 402, and FIG. 4B illustrates a second body 204 including a rectangular aperture 404. In embodiments, the aperture is sized to be slightly larger than the emblem which it is configured to receive. For example, in the embodiment shown in FIGS. 4A and 4B, the clearance between the sides of the emblem and the sides of the aperture may be 0.2 mm to 1.5 mm. In embodiments, the aperture may be configured to have a press fit with the emblem. For example, the aperture may be slightly smaller in dimension than the emblem and the resiliency of the raised emblem allows the emblem to slightly compress to be received in the aperture. In embodiments the second body may comprise a resilient material around the aperture to provide a press fit with the raise emblem. Further, in embodiments the aperture may have a shape which allows portions of the outline of the aperture to contact the raised emblem to form a press fit and the shape may also include portions that during normal conditions have a clearance with the raised emblem.

Figure 4C:
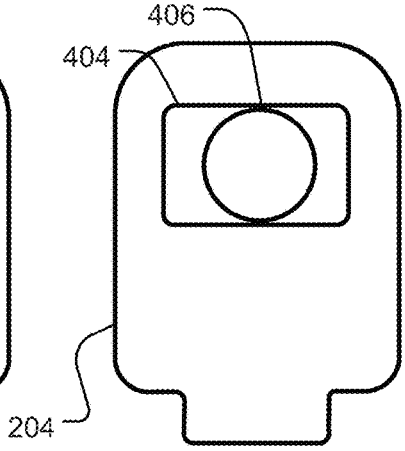
FIG. 4C illustrates an aperture corresponding to a rectangular emblem receiving a button of a baseball style hat.

FIG. 4C illustrates the aperture 404 of FIG. 4B being used to create a press fit with the button 406 of a hat to attach a hat to the clip apparatus. In this configuration, the top surface 242 of the second body faces the outer covering portion of a hat, and attachment of the hat does not include a portion of the hat being received in the cavity between the first and second bodies.

While the embodiment of the clip apparatus discussed thus far includes a rectangular aperture to be used to attach a hat with a rectangular raised emblem, in embodiments the aperture may be of other shapes to be used with raised emblems of corresponding shapes.

Figure 5A:
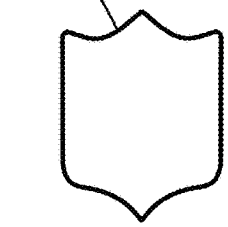
FIGS. 5A, 5B and 5C illustrate a shield shaped emblem and corresponding aperture.
Figure 5B:
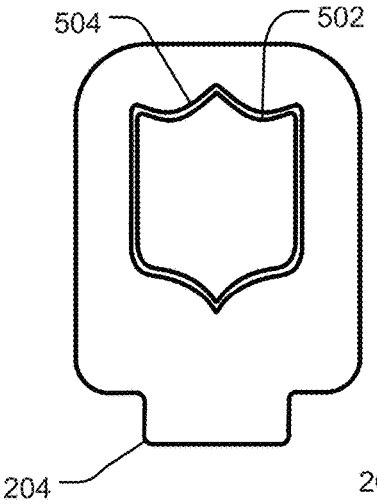
Figure 5C:
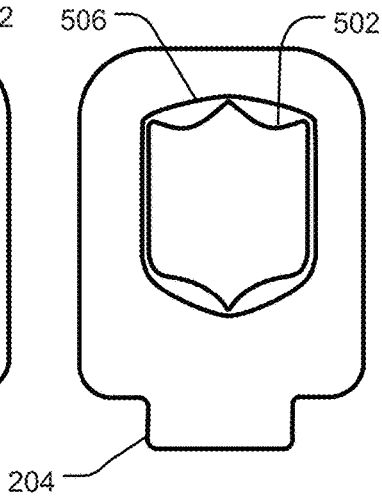

FIGS. 5A-C illustrate a shield shaped emblem 502 and two aperture shapes which may receive the shield shaped emblem. As shown, the shield shaped aperture 504 in FIG. 5B includes a shape closely corresponding to the shield shaped emblem 502. However, in embodiments apertures may have a shape which less closely corresponds to the shape of emblem which the aperture is configured to receive. For example, the shape of the aperture may be a rough outline of the emblem and only include convex surfaces. For example, FIG. 5C illustrates an embodiment of a rounded shield shape aperture 506 which corresponds to the shield shaped aperture 504 of FIG. 5A and has a simplified shape which does not include features corresponding to the points of the shield shaped emblem 502.

Figure 6A:
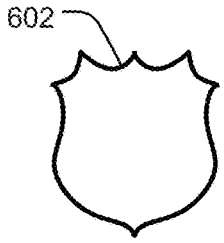
FIGS. 6A, 6B and 6C illustrate a shield shaped emblem and corresponding aperture.
Figure 6B:
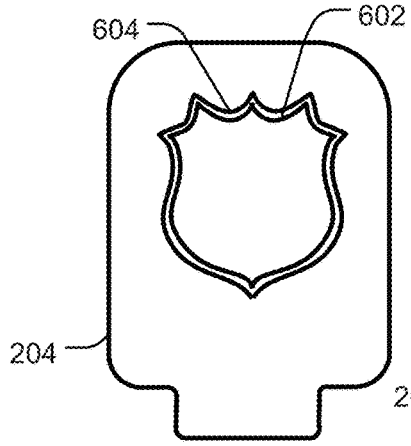
Figure 6C:
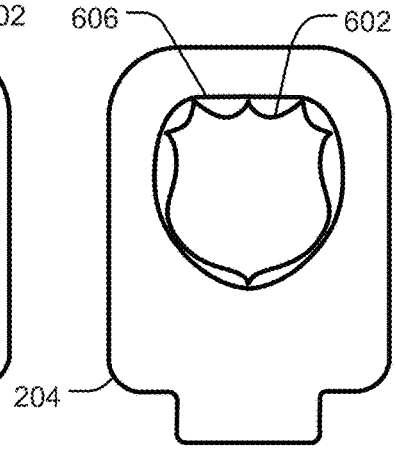

FIGS. 6A-C illustrate a shield shaped emblem 602 and two aperture shapes which may receive the shield shaped emblem, similar as discussed in FIGS. 5A-C. The shield shaped aperture 604 in FIG. 6B includes a shape closely corresponding to the shield shaped emblem 602 and the rounded shield shape aperture 606 corresponds to the shield shaped aperture 604 and is configured to contact or be closely adjacent to the outside points of the shield shaped emblem 602.

Figure 7A:
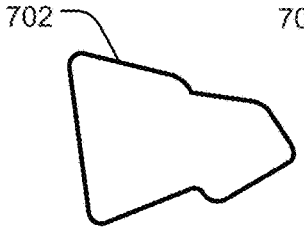
FIGS. 7A and 7B illustrate an asymmetrical shaped emblem and corresponding aperture.
Figure 7B:
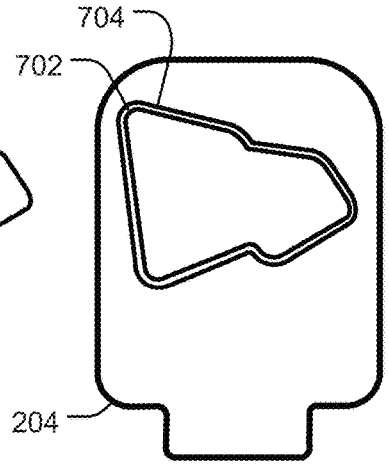
Figure 8A:
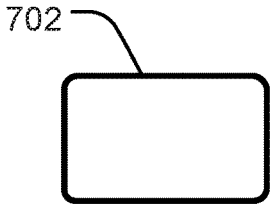
FIGS. 8A, 8B, 8C, and 8D illustrate rectangular and circular emblems and a corresponding aperture.
Figure 8C:
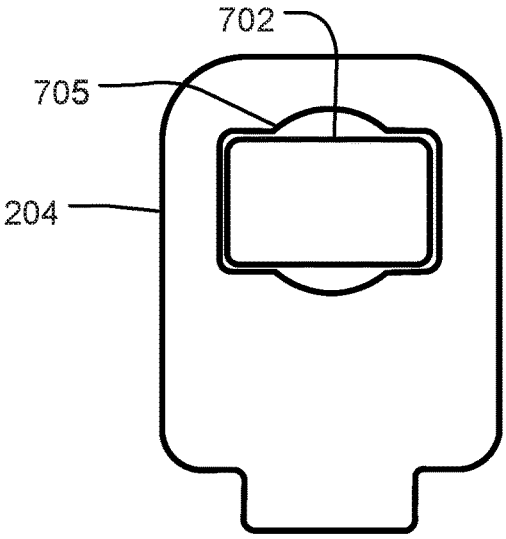
Figure 8B:
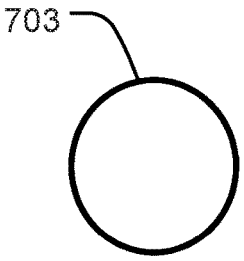
Figure 8D:
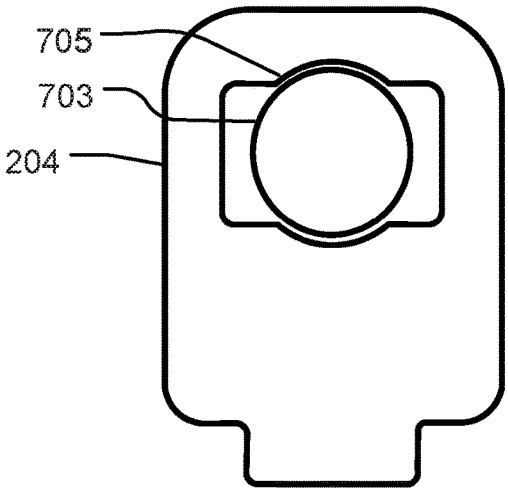

While the raised emblems disclosed thus far have included symmetry in at least one direction, embodiments may include raised emblems and corresponding apertures without symmetry which form the mechanical interlock discussed above. For example, FIG. 7A includes an asymmetrical emblem 702 and FIG. 7B includes an asymmetrical aperture 704 to receive asymmetrical emblem 702.

In embodiments the aperture may have a shape capable of receiving and creating a mechanical interlock, as discussed above, for two or more differently shaped raised emblems. For example, FIGS. 8A-D show an embodiment including a rectangular emblem 702, a circular emblem 703, and an aperture 705 having a shape which can receive and create a mechanical interlock with both the rectangular and circular emblems. While the embodiment shown includes two simple shapes, an aperture may be shaped to receive more complex shapes, for example any combination of two or more of the emblems of FIGS. 4A-7B. Further, in embodiments, the aperture may be shaped and sized to also be attachable to the button on a baseball style hat with a friction fit, as noted above.

While the present invention is disclosed by reference to the preferred embodiments and examples detailed above, it is to be understood that these examples are intended in an illustrative rather than in a limiting sense. It is contemplated that modifications and combinations will readily occur to those skilled in the art, which modifications and combinations will be within the spirit of the invention and the scope of the following claims.

What is claimed is:

1. A hat attachment device for removably attaching to a hat, the hat of a type comprising a main hat body and a sweatband, the main hat body having a head opening, and inner and outer surfaces, the sweatband having a lower edge attached to the main hat body at the head opening forming a channel between the inner surface of the main hat body and an outer surface of the sweatband, the sweatband having an upper edge not attached to the main hat body, the hat attachment device comprising:

a first body, comprising a first end and a second end, a first surface and a second surface opposite the first surface;

a second body, including a third surface and a fourth surface opposite the third surface, a hinge assembly pivotally coupling the second body to the first body and configured to allow the second body to pivot relative to the first body from an open position and to a closed position, wherein in the closed position a cavity is formed comprising side walls defined by the second surface of the first body and the third surface of the second body; and a retainer extending from the second end of the first body, comprising;

a first portion configured to abut the upper edge of the sweatband, and a second portion, extending from the first portion toward the first end of the first body, and configured to be positioned in the channel of the hat between the inner surface of the main hat body and the outer surface of the sweatband with the lower edge of the sweatband positioned within the cavity.

2. The device of claim 1, wherein the first end of the first body comprises an attachment mechanism configured to removably attach an article to the first end of the first body.

3. The device of claim 2, wherein the attachment mechanism comprises a hook and a spring gate.

4. The device of claim 1, wherein the second body comprises an aperture between the third and fourth surfaces configured to receive a raised emblem located on the outside surface of the main hat body.

5. The device of claim 1, further comprising a clasp slidable between an engaged position and a disengaged position, wherein in the engaged position the clasp creates a biasing force to bias the first and second bodies toward the closed position.

6. A hat attachment device for removably attaching to a hat, the hat of a type comprising a main hat body and a sweatband, the main hat body having a head opening, and inner and outer surfaces, the sweatband having a lower edge attached to the main hat body at the head opening forming a channel between the inner surface of the main hat body and an outer surface of the sweatband, the sweatband having an upper edge not attached to the main hat body, the hat attachment device comprising:

a first body, comprising a first end and a second end, a first surface and a second surface opposite the first surface;

a second body, comprising a third surface and a fourth surface opposite the third surface, and a hinge assembly pivotally coupling the second body to the first body and configured to allow the second body to pivot relative to the first body from an open position and to a closed position, wherein in the closed position a cavity is formed comprising side walls defined by the second surface of the first body and the third surface of the second body;

wherein the second body includes an aperture between the third and fourth surfaces configured to receive a raised emblem located on the outside surface of the main hat body, wherein the first end of the first body comprises an attachment mechanism configured to removably attach an article to the first end of the first body, and wherein the attachment mechanism comprises a hook and a spring gate.

7. The device of claim 6, further comprising a retainer extending from the second end of the first body, the retainer comprising:

a first portion configured to abut the upper edge of the sweatband; and a second portion, extending from the first portion toward the first end of the first body, and configured to be positioned in the channel of the hat between the inner surface of the main hat body and the outer surface of the sweatband with the lower edge of the sweatband positioned within the cavity.

8. The device of claim 6, further comprising a clasp slidable between an engaged position and a disengaged position, wherein in the engaged position the clasp creates a biasing force to bias the first and second bodies toward the closed position.

9. The device of claim 6, wherein the aperture comprises a shape configured to receive a raised emblem of a first shape, and a raised emblem of a second shape, different than the first shape.

10. A method of attaching a hat to a hat attachment device, the hat of a type comprising a main hat body and a sweatband, the main hat body having a head opening, and inner and outer surfaces, the sweatband having a lower edge attached to the main hat body at the head opening forming a channel between the inner surface of the main hat body and an outer surface of the sweatband, the sweatband having an upper edge not attached to the main hat body, the method comprising:

providing the hat attachment device, the hat attachment device comprising:

a first body, comprising a first end and a second end, a first surface and a second surface opposite the first surface;

a second body, comprising a third surface and a fourth surface opposite the third surface, a hinge assembly pivotally coupling the second body to the first body and configured to allow the second body to pivot relative to the first body from an open position and to a closed position, wherein in the closed position a cavity is formed comprising side walls defined by the second surface of the first body and the third surface of the second body; and a retainer extending from the second end of the first body, comprising;

a first portion extending from the first surface of the first body; and a second portion, extending from the first portion toward the first end of the first body; and positioning the lower edge of the sweatband of the hat in the cavity between the first and second body, with the upper edge of the sweatband contacting the first portion and the second portion being located within channel of the hat, to create a mechanical interlock preventing the hat from being removed from the hat attachment device in the closed position.

11. The method of claim 10, wherein the first end of the first body includes an attachment mechanism configured, and the method further comprising:

attaching the attachment mechanism to a bag.

12. The method of claim 11, wherein the attachment mechanism includes a hook and a spring gate; and the method further comprising:

attaching the hook of the attachment mechanism to the bag.

13. The method of claim 10, wherein the second body includes an aperture between the third and fourth surfaces, and the method further comprising:

positioning a raised emblem located on the outside surface of the main hat body within the aperture to create a second mechanical interlock which prevents the hat from being removed from the hat attachment device in the closed position.

14. The method of claim 10, the hat attachment device further comprising a clasp slidable between an engaged position and a disengaged position, and the method further comprising:

positioning the clasp in the engaged position to create a biasing force to bias the first and second bodies toward the closed position.

* * * * *